US005090699A

United States Patent [19]

Friedman

[11] Patent Number: 5,090,699

[45] Date of Patent: Feb. 25, 1992

[54] GAME

[75] Inventor: Ira Friedman, West Palm Beach, Fla.

[73] Assignee: Tri-Tec Industries Ltd., West Palm Beach, Fla.

[21] Appl. No.: 676,431

[22] Filed: Mar. 28, 1991

[51] Int. Cl.[5] ..... A63F 07/02

[52] U.S. Cl. ..... 273/126 R; 273/118 R; 273/120 R; 273/121 R; 273/121 B

[58] Field of Search ..... 273/108, 118 R, 119 R, 273/120 R, 121 R, 121 B, 122 R, 125 R, 126 R, 126 A

[56] References Cited

U.S. PATENT DOCUMENTS

| | | | |
|---|---|---|---|
| 3,797,828 | 3/1974 | Ishikawa et al. | 273/121 B X |
| 3,825,265 | 7/1974 | Pittcanen et al. | 273/126 R |
| 4,508,336 | 4/1985 | Yokoi | 273/121 B X |
| 5,016,879 | 5/1991 | Parker et al. | 273/121 B X |

*Primary Examiner*—William H. Grieb
*Assistant Examiner*—Raleigh W. Chiu

[57] ABSTRACT

A slot game utilizing coins provides an enclosed partially transparent case having at an upper end thereof input slots for placing coins into each of a plurality of vertical columns. At the lower end is positioned a coin retrieval slot the allows removal of the coins upon pulling of a handle. Between the uppermost and lowermost points on the case are disposed a plurality of horizontal rows of blocks and slots. The slots are sized to receive coins of a predetermined size. The blocks and slots of each row are individually movable horizontally to allow movement of the coins between columns, thus, facilitating passage of coins in the slots from upper to lower rows. Each row of blocks and slots may be operated for horizontal movement individually by means of slides projecting from the case along one side of its face.

27 Claims, 10 Drawing Sheets

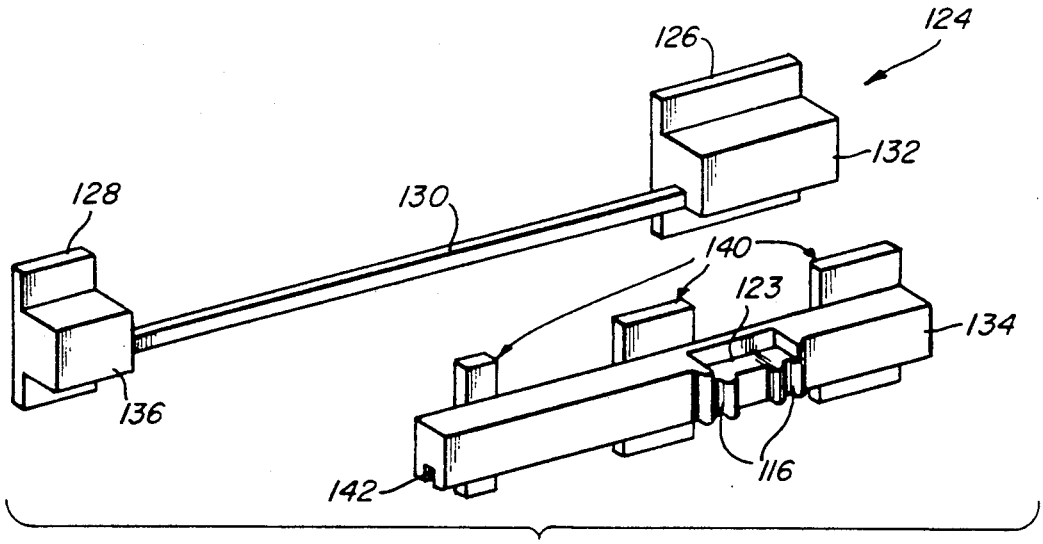
Fig. 9
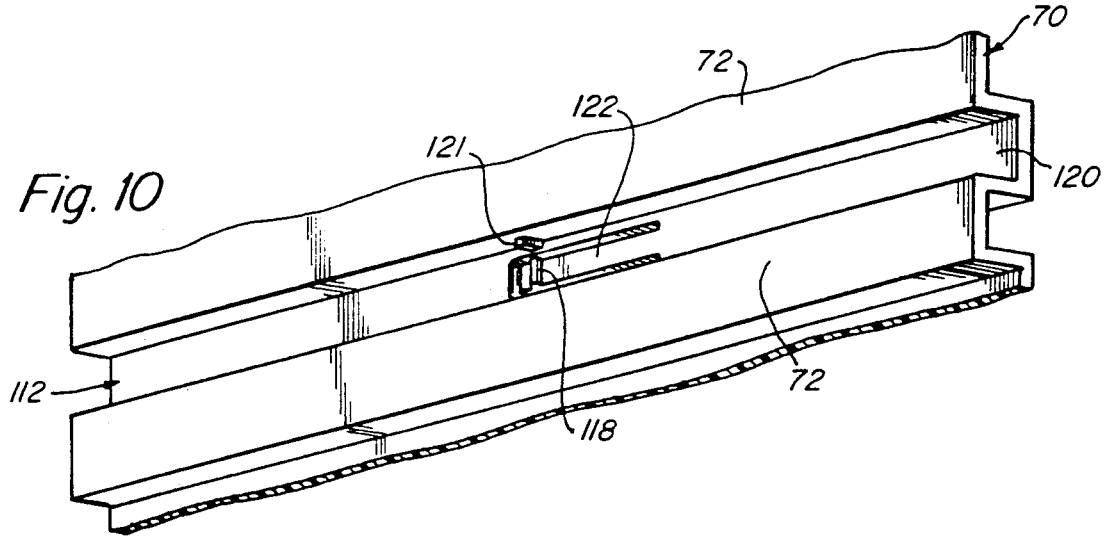
Fig. 10
Fig. 11
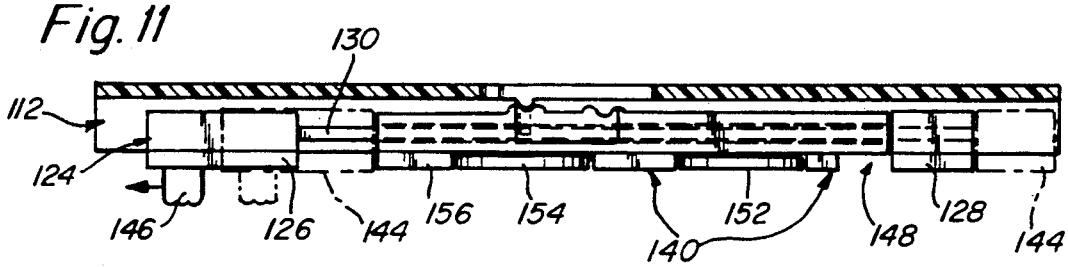
Fig. 12
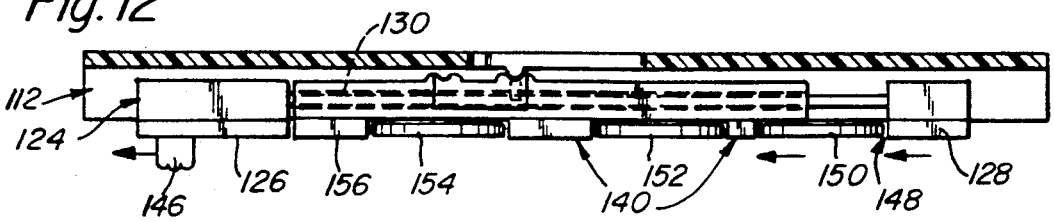

Fig. 13
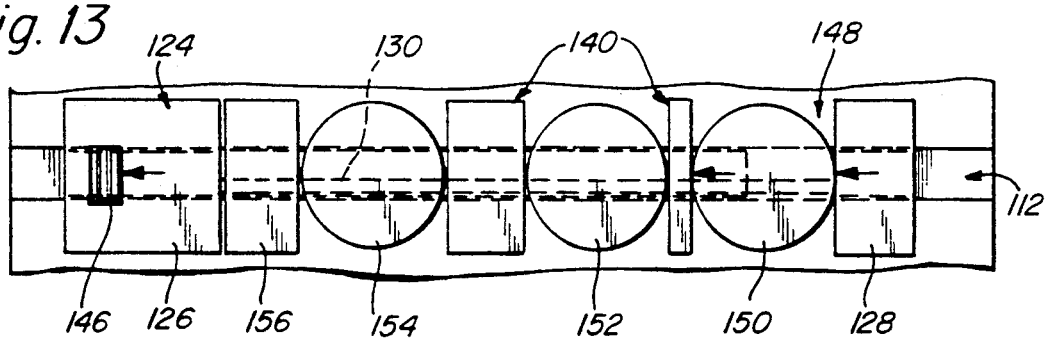
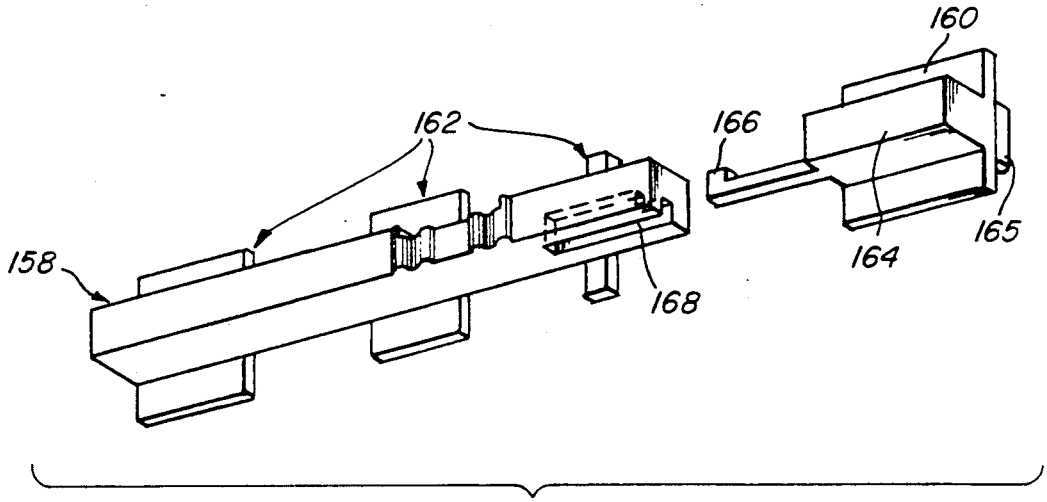
Fig. 14
Fig. 15
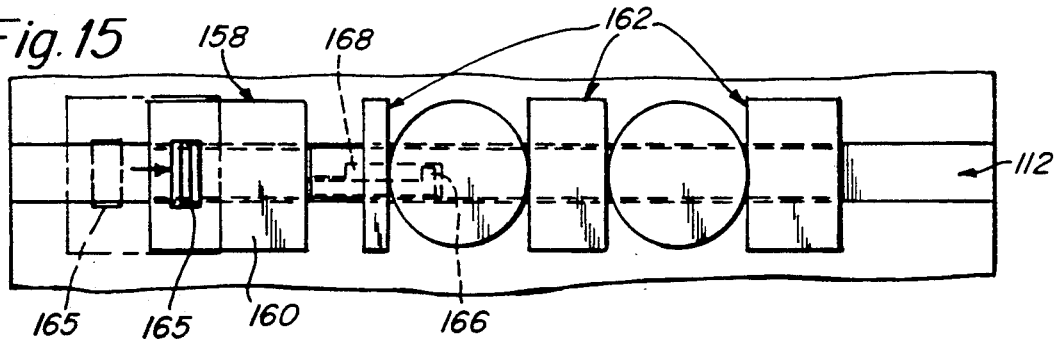
Fig. 16
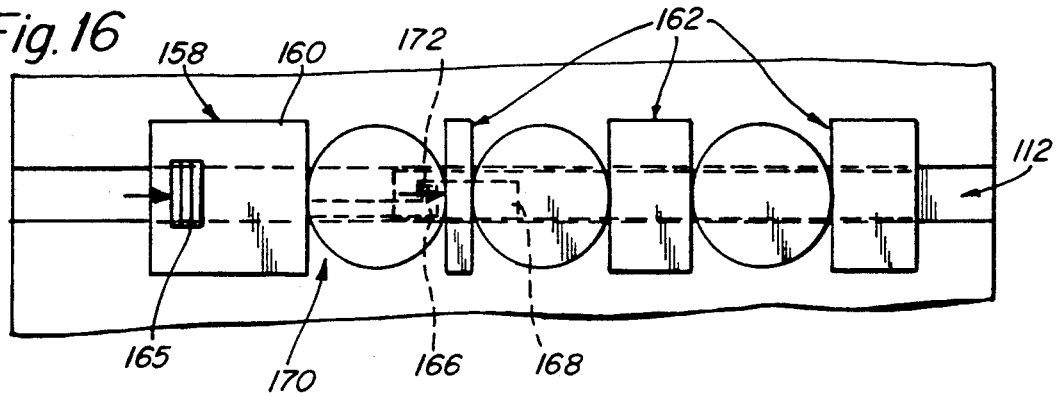

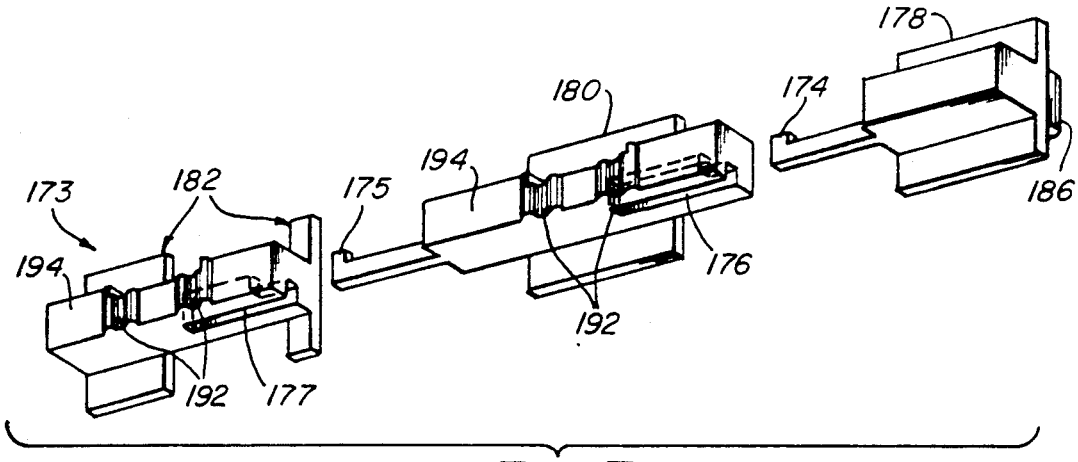
Fig. 17
Fig. 18
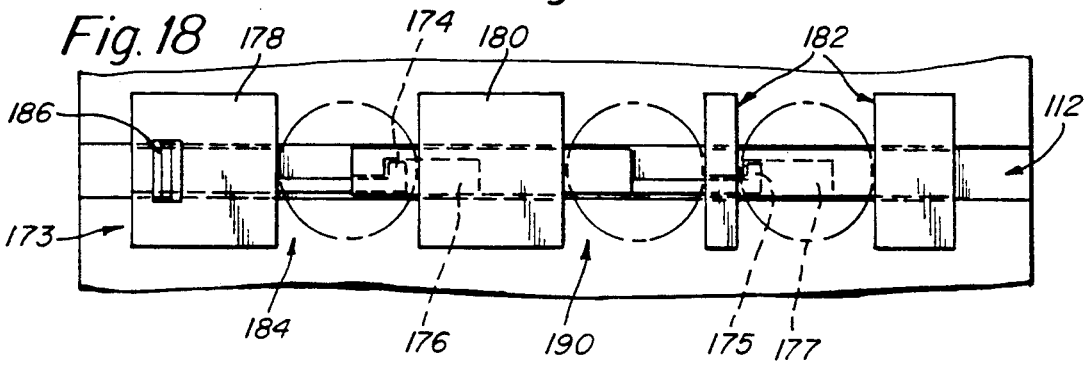
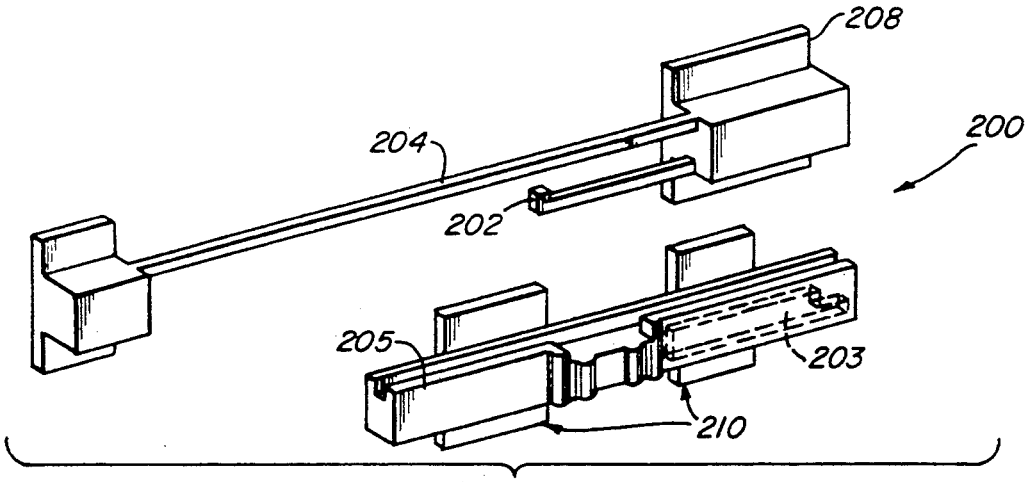
Fig. 19
Fig. 20
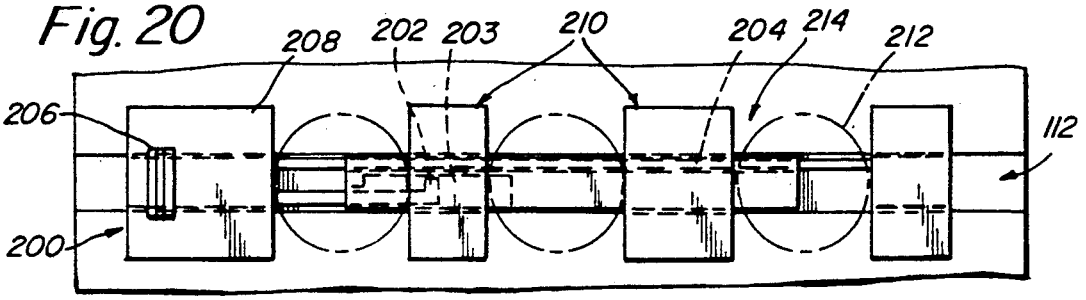

GAME

FIELD OF THE INVENTION

This invention relates to slot games and more particularly to a game of skill the object of which is to manipulate coins or the like through a slot maze so as to maximize the number received by each player.

BACKGROUND OF THE INVENTION

Puzzles and other mechanical skill games have remained popular over the years. Such games are highly effective learning tools, serving to build and maintain the strategic and critical thinking faculties of the participant.

Many skill games, however, contain no inherent motivating feature other than the player's innate desire to win. As a result, many complex skill games have failed to keep the attention, or otherwise entertain, less motivated and younger players. It would be desirable to develop a game of pure skill that employs time honored monetary incentives reminiscent of popular gambling games. In particular, it would be desirable to structure a skill game that actually utilizes coinage as a playing piece.

SUMMARY OF THE INVENTION

It is therefore an object of the present invention to provide a game of skill that increases the participants' motivation to win.

It is another object of this invention to provide a game of skill that utilizes conventional coins as playing pieces.

It is another object of this invention to provide a game of skill that requires significant strategic thinking and problem solving capabilities, but is fast paced and enjoyable to play.

It is yet another object of this invention to provide a game of skill that may be adapted to utilize coins of a variety of different denominations and nations in a standardized structure.

A slot game utilizing coins according to this invention comprises an enclosed case having a transparent front panel. The upper edge of the case includes a series of entry slots for insertion of coins. The slots each carry a release mechanism that allows the coin to drop from the slot into the case in response to the pressing of a button. The coins utilized are of a predetermined size and, in this example, are U.S. quarters. When the release button is pressed the coins drop into the first of, in this example, seven rows of individually horizontally movable blocks and slots. The slots in each row are sized to accept the coin. The blocks in one row are generally offset relative to those in the next row so that a coin in the first row does not automatically pass to the next lower row. Since the blocks and slots in each row are horizontally movable, however, by activating a slide control along one side of the case, the row of blocks may be reoriented so that a particular coin or coins becomes aligned with slots in an adjacent lower row. The coin then is free to fall into the slot of the next lower row.

The players take turns adding new coins to the insert slots and manipulating the horizontal positioning of blocks and slots in each row in order to position as many coins as possible into the lowest row. From this row, coins may be retrieved by the player using a release handle that allows the coins to exit through an exit slot.

For added complexity, some or all of the rows of blocks and slots may include particular sets of blocks that are disconnected from the slide controlled blocks and, therefore, may only be moved by the intervention of a coin in a slot between a slide block and a disconnected set block. Additionally, the case may include horizontally disposed stops positioned at predetermined points between some of the rows that further complicate the manipulation of coins from upper to lower rows. Further, the block sets in each row may be constructed with a multiplicity of disconnected sets of blocks and each of the sets may include releasable locking elements that provide for the alternative positioning of the set in one of either an extended or unextended position exclusively.

BRIEF DESCRIPTION OF THE DRAWINGS

The foregoing and other objections of this invention will become more apparent with reference to the following detailed description and drawings in which

FIG. 9 is a rear exploded perspective view of one type of two piece coin operated block assembly for use with the game of FIG. 1;

FIG. 10 is a partial front perspective view of the block guide panel including the locking spring for use with the game of FIG. 1;

FIG. 11 is a cross-sectional top view of the operational pattern of the block arrangement of FIG. 9 with no operating coin present in either operating slot;

FIG. 12 is a cross-sectional top view of the block arrangement of FIG. 9 with an operating coin positioned in the rightmost slot;

FIG. 13 is a front view of the block arrangement of FIG. 12;

FIG. 14 is a bottom oriented exploded perspective view of a second type of two piece coin operated block arrangement for use in the game of FIG. 1;

FIG. 15 is a front view of the operation of the block arrangement of FIG. 14 without an operating coin present;

FIG. 16 is a front view of the operation of the block of FIG. 14 with an operating coin positioned therein;

FIG. 17 is a bottom rear oriented exploded perspective vie of a three piece coin operated block arrangement for use with the game of FIG. 1;

FIG. 18 is a front view of the unextended position of the block arrangement of FIG. 17 with three coins positioned therein;

FIG. 19 is a top/rear oriented exploded perspective view of an alternative embodiment of a three piece coin operated block arrangement for use with the game of FIG. 1;

FIG. 20 is a front view of the block of FIG. 19 in an unextended position having three coins positioned therein;

DETAILED DESCRIPTION OF THE PREFERRED EMBODIMENTS

Figure 1:
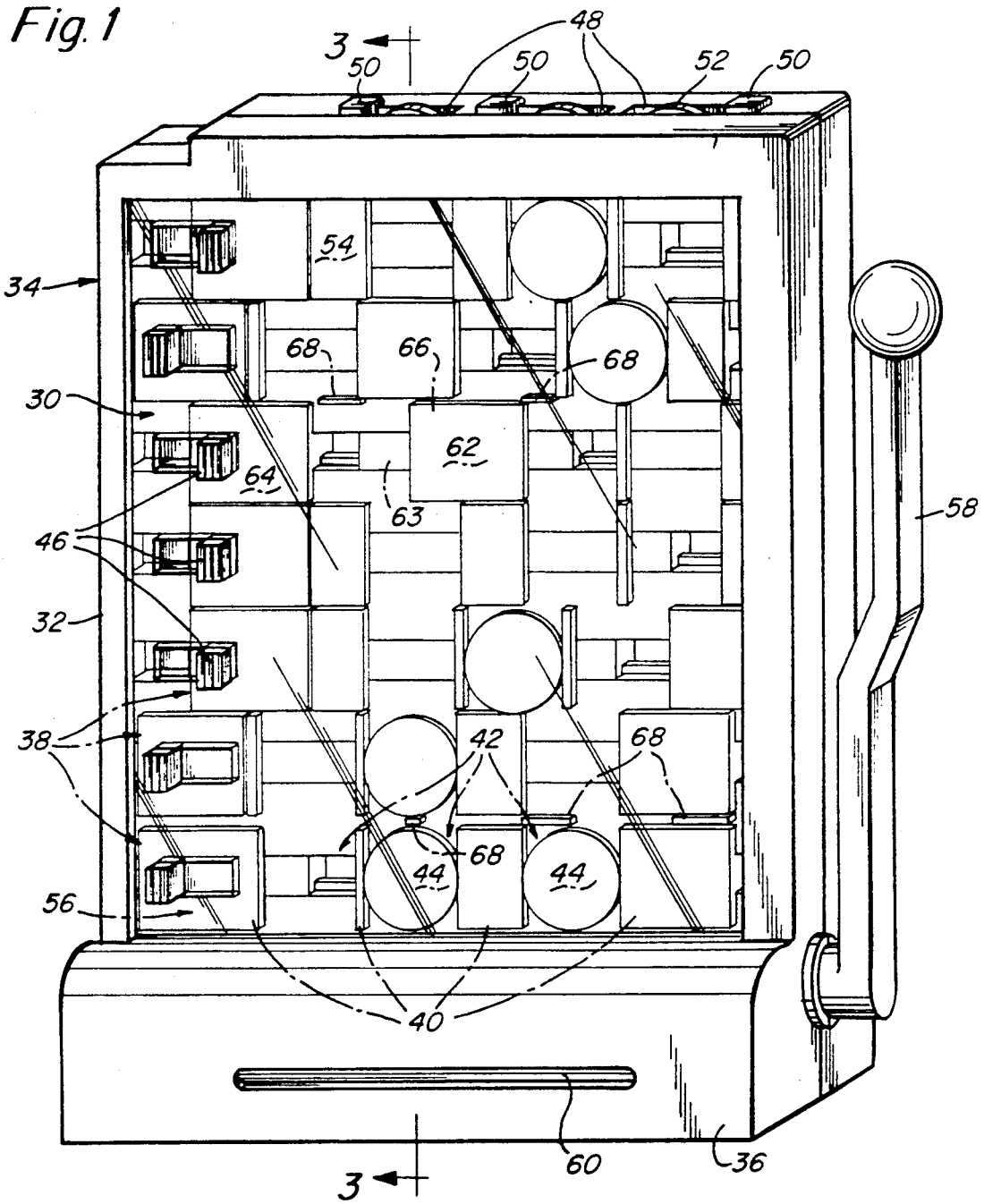
FIG. 1 is a perspective front view of a slot game utilizing coins according to this invention.
Figure 2:
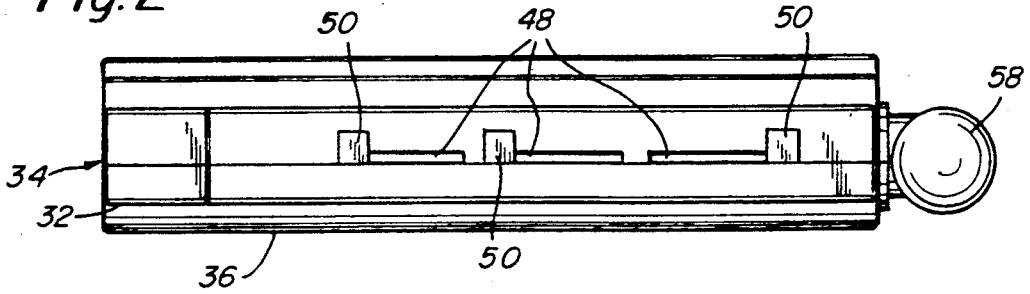
FIG. 2 is a top view of the game of FIG. 1.

A slot game using coins is shown in its assembled form in FIGS. 1 and 2. The game comprises a transparent front panel 30 held in place by an integral bezel 32 attached to a surrounding case 34 that stands substantially vertically. The case's base 36 is somewhat larger in area (footprint) than the upwardly disposed portion of the case 34 in part to facilitate the game's stability in a freestanding mode. The case 34 and other game components may be constructed of a plastic material such as polystyrene or other suitably formable material.

As viewed through the clear front panel, the game includes, in this example, seven vertically aligned rows of irregularly spaced block sets 38 that closely abut the inner disposed surface of the clear panel 30. Between each of these blocks 40 are vertically oriented open areas or slots 42 that are sized in height, width and depth to accept a predetermined shape of coin 44. In this example, a size suitable to accept U.S. or Canadian quarters is contemplated. However, slugs of similar size may be alternatively employed where the players do not wish to use actual currency. Each of the rows of blocks 38 is maneuverable horizontally relative to the game case by means of individual finger controlled slides 46 projecting through the clear panel 3 along the left side thereof.

The object of the game, thus, is to insert coins 44 through one or more of three entry slots 48 positioned along the top surface of the game case. At a predetermined time, a release button 50 is pressed allowing the inserted coin 52 to drop from the entry slot 48 into the slots of uppermost slot and block arrangement (row) 54. From there, the coins 44 are manipulated (by using the slides to align the slots of adjacent lower rows with coins in upper rows thereby causing them to drop into the next lowest row of slots) by one or more players in turn through each of the remaining lower rows of blocks and slots until they are positioned in the lowermost block arrangement 56 proximate the base. Throughout the game, additional coins may be added to the game through the entry slots 48 on the basis of specific rules.

A handle 58, when pulled forwardly away from the case 34, allows the coins 44 to drop from the bottom row block arrangement 56 through an exit slot 60 and, thus, out of the game. According to one example, the rules of the game may be designed so that players continually input coins for each turn taken while manipulating various block arrangements. As such, the player who is able to retrieve the greatest number of coins from the exit slot 60 during his or her turn for the lowest "investment" of coins inserted wins. Winning, therefore, results from careful assessment of the necessary block manipulation in order to place the maximum number of coins in a position to be removed at a given time. Thus a great deal of strategic thinking must be utilized in operating the game.

An added challenge in playing the game is the utilization of coin operated blocks in various rows of the game. Their structure will be described further below, but generally, these blocks (62 in FIG. 1 for example) are slidably disconnected in a variety of ways so that moving the slide at the left side of the panel does not cause each block in the particular row to simultaneously move horizontally, rather, the disconnected blocks in the row may only move horizontally if a coin is disposed in the slot (63 for example) between the slide connected block (64 for example) and the disconnected blocks (66 for example) in order to create the necessary connection for sliding to occur. As such, a greater level of strategic thinking is necessary to operate the game, taking into account the inoperability of some blocks without coins properly positioned therein.

Figure 22:
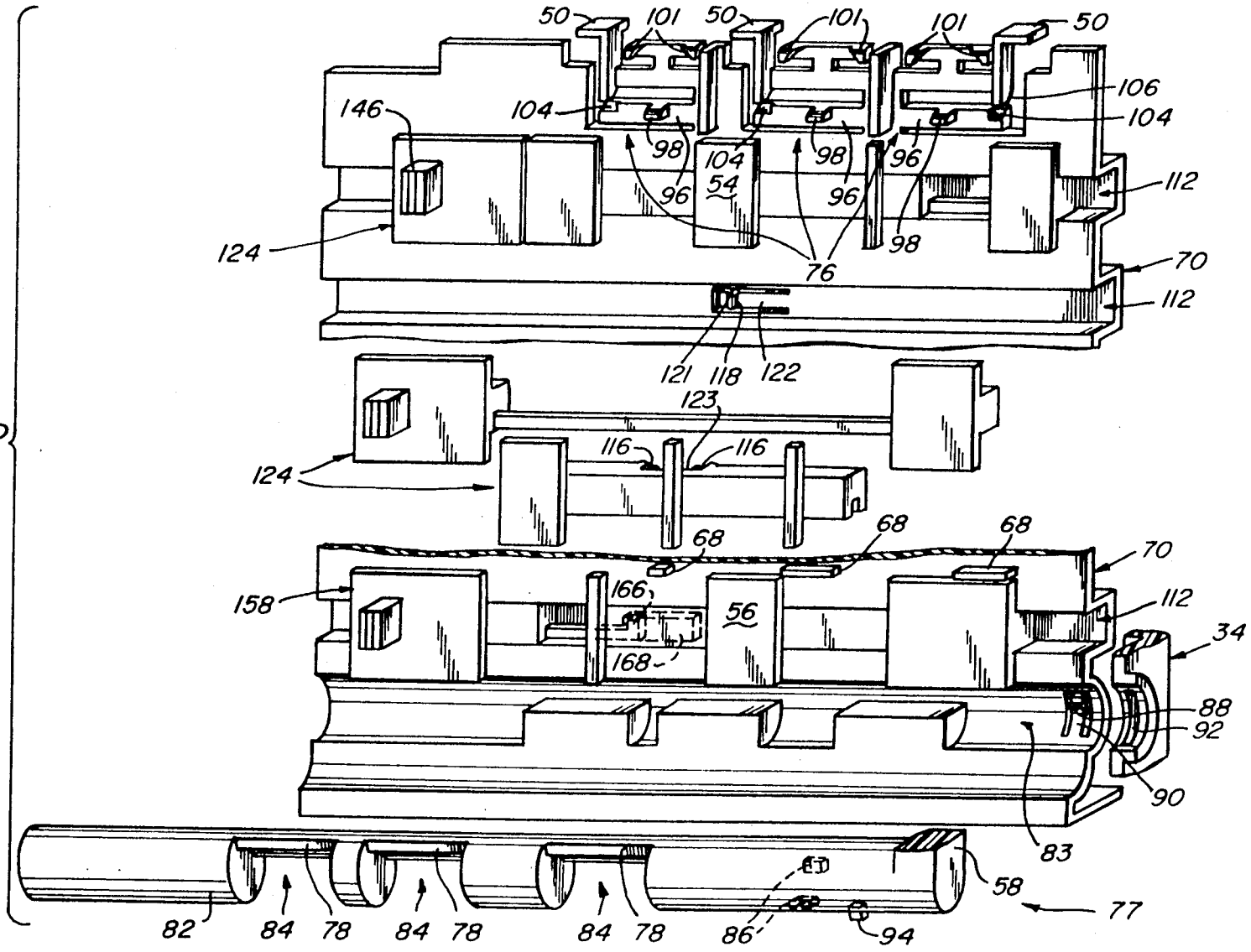
FIG. 22 is an exploded fragmentary front view of the upper and lower halves of the game of FIG. 1 detailing the structure of various components.

The game may be further complicated through the inclusion of fixed protrusions or stops 68 of various horizontal length between rows of blocks that prevent the downward movement of coins in a particular horizontal location. As such, careful and preplanned reorientation of multiple levels of blocks is required of the player to circumvent the stops 68. Stops may actually be molded into the game case structure as detailed in, for example, FIG. 22.

Figure 3:
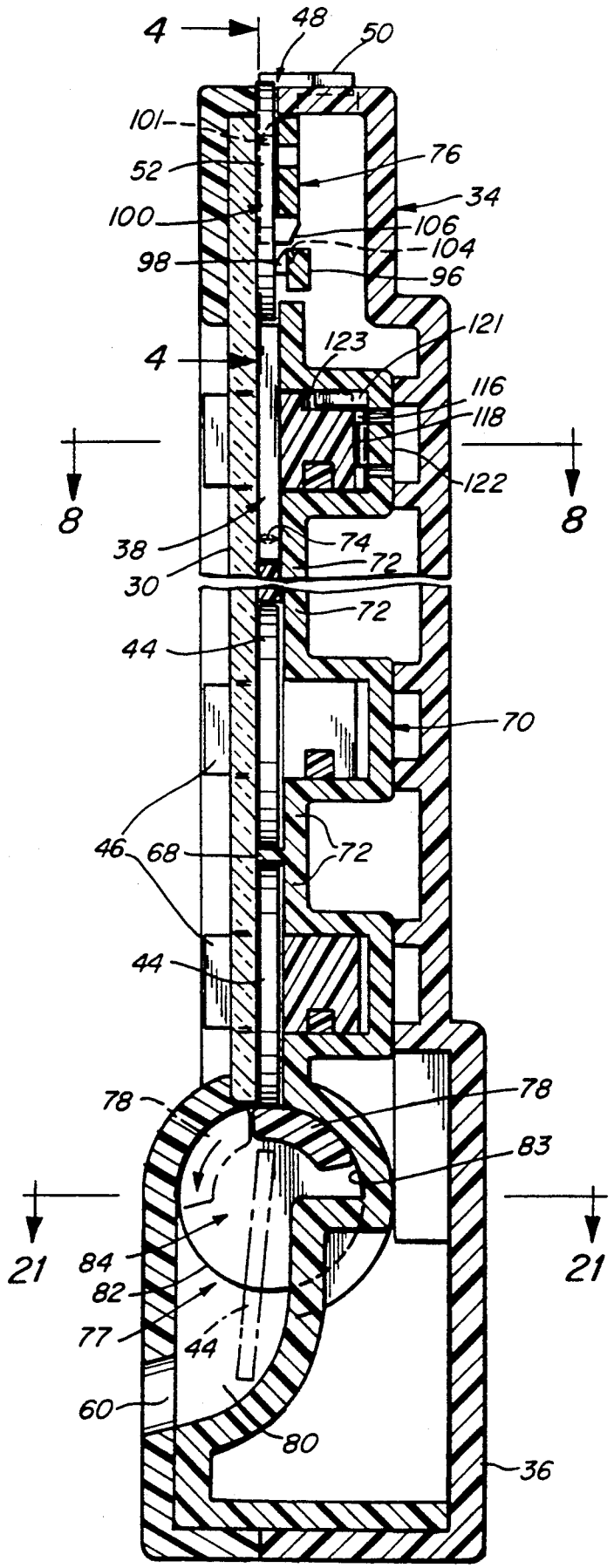
FIG. 3 is a cross sectional side view of the game of FIG. 1 taken along line 3—3 detailing the internal structure thereof.
Figure 4:
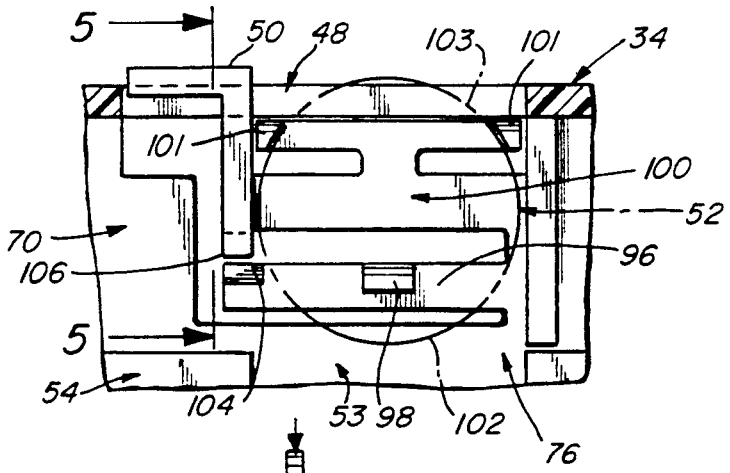
FIG. 4 is a partial exposed front view of the coin release for the game taken along line 4—4 of FIG. 3.

The basic construction of the game of FIG. 1, according to this embodiment, is illustrated cross-sectionally in FIG. 3. As depicted, each row of blocks 38 rides within a channel of an integral block guide tray 70 positioned proximate the rearmost part of the case 34. The forwardly disposed portions 72 of the tray 70 are flat and spaced at a predetermined distance 74 from the clear front panel 30 allowing sufficient spacing for specifically sized coins 44 to pass in slots therebetween without interference. The stops 68 between rows of blocks 38 are also clearly depicted and extend from the flat forwardly disposed portions 72 of the tray 70 to the inwardly disposed face of the panel 30. The inserted coin release mechanism 76 is also shown and will be described further below.

Figure 21:
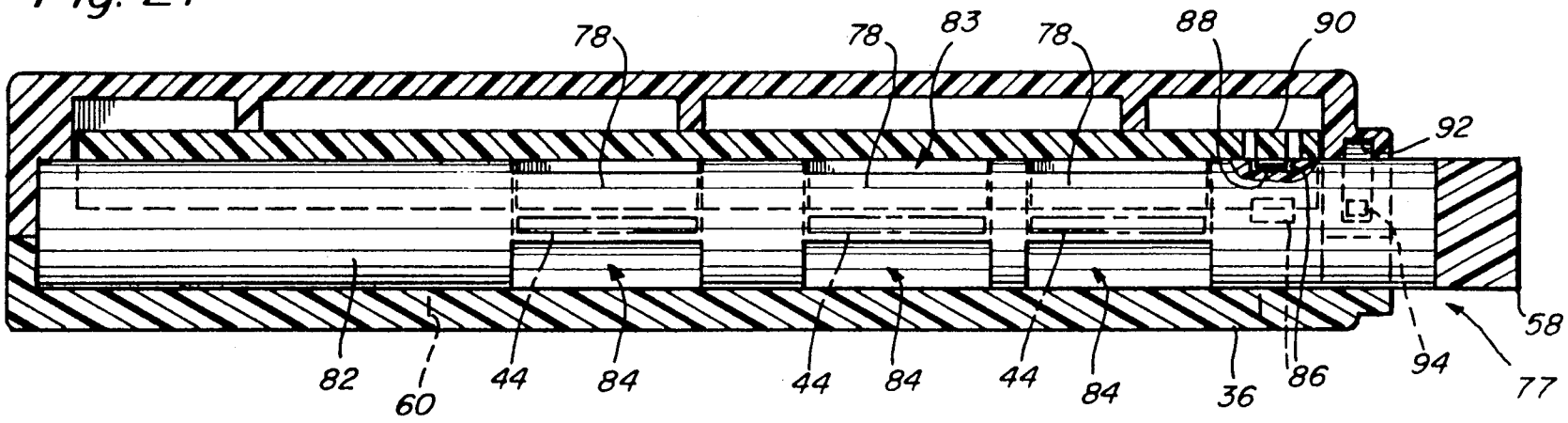
FIG. 21 is a cross-sectional top view of the handle release mechanism taken along line 21—21 of FIG. 3.

Additionally, the handle 58 operated coin removal mechanism 77 is depicted and includes a rotating cam 78 that allows coins 44 to drop from the bottom row 56 into a channel 80 having at its bottom end the exit slot 60 through which each coin 44 passes to be retrieved by the player. The handle mechanism 77 is shown in further detail in cross sectional top view in FIG. 21. The handle mechanism 77 consists of a cylindrical shaft 82 mounted in a molded recess 83 in the case 34 having three partially hollowed regions 84 defining each of three coin release slots (See also FIG. 22). Thus, coins in each of the lowermost row 56 slots must be horizontally aligned with the shaft hollowed regions 84 for release. The solid areas or cams 78 normally cover each of the release openings proximate the bottom row 56 slots.

When the handle 58 is rotated, the hollow areas become aligned with the bottom rows 56 slots allowing the coins to pass through and into the exit slot 60. The handle mechanism shaft 82 further includes a pair of detents 86 positioned at 90° angles to each other along its surface. Each of the detents 86 is disposed to alternately engage a protrusion 88 on a molded spring arm 90 located upon the case recess 83 proximate the handle 58. The spring arm 90 provides a slight resistance pressure and, thus, serves to maintain the shaft 82 in either of the coin hold or coin release modes. To prevent axial motion of the cylinder out of the case 34, an annular groove 92 is positioned near the outer edge of the case into which a pin 94 molded upon the cylinder is positioned. The pin 94 holds the shaft 82 axially while allowing rotational movement for releasing coins 44.

Figure 5:
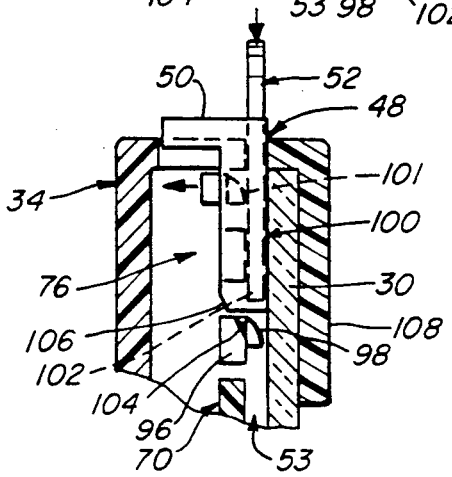
FIG. 5 is a more detailed partial cross-sectional side view of the coin release taken along line 5—5 of FIG. 4 detailing partial insertion of a coin.
Figure 6:
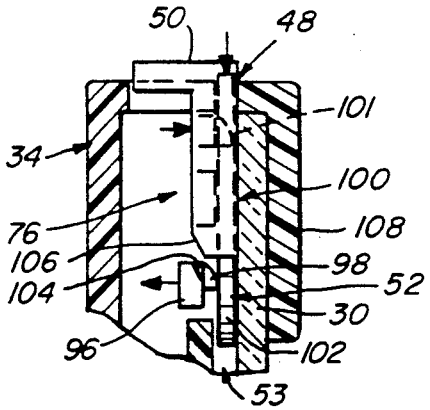
FIG. 6 is the coin release of FIG. 5 showing the full insertion of a coin thereto.
Figure 7:
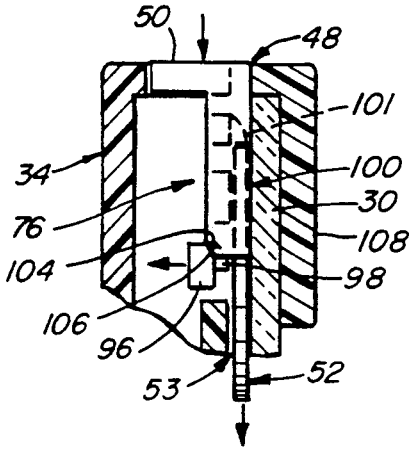
FIG. 7 is the coin release of FIG. 5 showing the release of a coin following the actuation of the release button

FIGS. 4–7 show in detail the structure and operation of the inserted coin release mechanism 76 for introducing newly added coins to an adjacent slot 53 in the uppermost row 54. In this example, the release mechanism 76 is molded as part of the block guide tray 70 from resilient plastic or other suitable material and includes a retention arm 96 having a protrusion 98 that normally extends forwardly into the slot region 100 of each entry slot 48. When a coin 52 is placed into the entry slot 48 through the top of the game case 34, the coin's bottom end 102 encounters the protrusion 98 (FIG. 5). As it is pushed flush with the top of the case surface, the protrusion 98 is forced rearwardly toward the case back by the coin 52 but, as a result of the protrusion's displacement, exerts pressure upon the coin 52 holding it flush against the clear front panel 30 (FIG. 6). Upon full insertion, the coin 52 also becomes locked by a pair of close fitting protruding coin stops 101 that spring back into place to abut the coin's upper edge 103. Those coin stops 101 prevent subsequent removal of the coin 52 once it is inserted, thus, requiring the player to advance it through the game instead. The coin 52 remains pressurably locked against the clear front panel 30 by means of the arm 96 and associated protrusion 98 until the release button 50 is pressed. The release button 50 causes an interfering contact between an outer forwardly disposed edge 104 of the arm and the lower edge 106 of the button 50 causing the arm to displace further rearwardly to disengage completely from the coin 52. As such, the coin 52 no longer undergoes any forward retention pressure and is free to drop from the slot region 100. The slot region 100, in this example, is not visible from a front on view due to the extended top bezel 108 positioned over the upper portion of the clear front panel 30.

Figure 8:
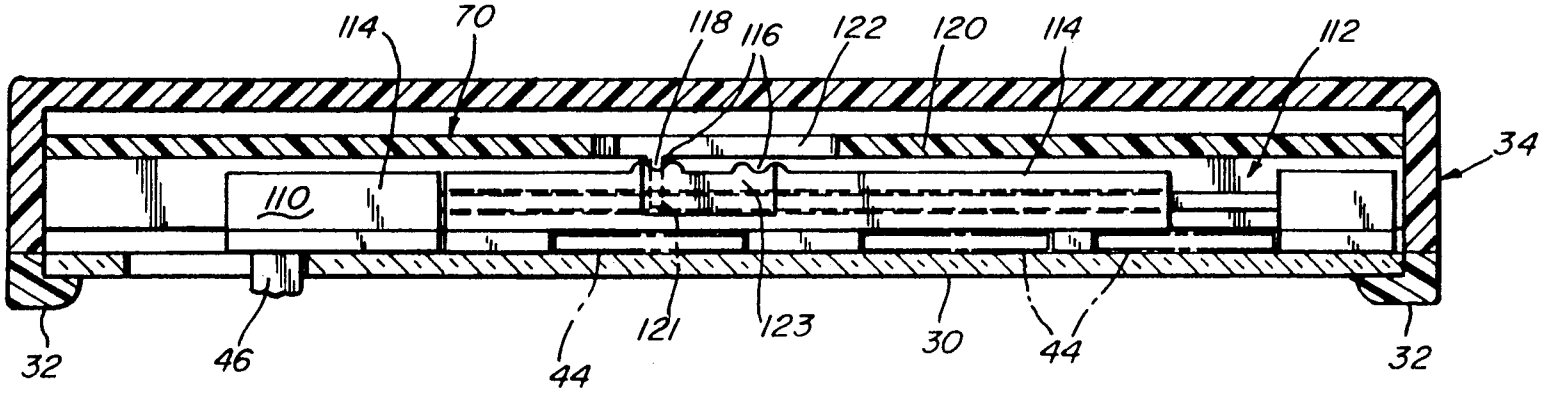
FIG. 8 is a cross-sectional top view of the game taken along line 8—8 of FIG. 3.

FIG. 8 illustrates a cross sectional view of the game through a typical block arrangement 110. The panel 30 and the opposing tray 70 of the channel 112 for guiding a lug 114 of block 110 are clearly visible. In particular, the block arrangement 110 includes a pair of indentations 116 adapted to alternately seat in a spring loaded protrusion 118 facing outwardly from the base 120 of the channel 112. The protrusion 118 is attached to a molded spring arm 122 similar to that used for the handle mechanism 77 that, in this example, is rectangularly shaped and joined along only one side to the block guiding channel base 120 The spring arm 122 and protrusion 118 are shown in greater detail in FIG. 10. (See also generally FIG. 22). The engagement of each indentation 116 with the spring arm protrusion 118 prevents inadvertent misalignment of the block arrangement in each row. In this example, two indentations are placed into the block arrangement 110 providing positive seating for the arrangement 110 in either of its extended or unextended (neutral or leftmost) positions. The user feels a firm click signifying when the block arrangement becomes fully seated in either of its positions. Further, since slight force is required to overcome the engagement between the protrusion and indentation, the block arrangement is largely prevented from disengaging from a chosen position inadvertently An added feature of the block lug 114 and guiding channel structure 112 according to this embodiment is the positioning, along one side wall of the channel 112, of a stop 121 that interengages with a slot 123 formed in the corresponding wall of the lug 114 of block arrangement (see FIGS. 8 and 10). The slot 123 corresponds to the locations of each of the indentations 116 and further prevents the block arrangement from overextending horizontally beyond its delineated limits. The general concept of indentations engaging with channel oriented springs is applicable to any of the block types described herein.

The particular type of block structure utilized in FIG. 8 is further depicted in FIG. 9. This block structure 124 is a two piece coin operated type structure depicted in rear view. From a front view reference the leftmost block 126 includes a slide control and is joined to the rightmost block 128 by a connecting rod 130. Each of the blocks includes a guiding lug 132, 134, 136 that rides within the guiding channel 112 (FIGS. 10–12) without substantial transverse (non-horizontal) movement. A central set of blocks 140 also rides independently relative to the leftmost and rightmost blocks 126 and 128 upon the connecting rod 130 itself. This is facilitated by a groove 142 placed along one side of the guiding lug 134 of the central block assembly 140.

As depicted in FIG. 11, if no coin is disposed between the leftmost block 126 and the intermediate assembly 140, the intermediate assembly 140 (in a fully extended position) fails to move further horizontally in response to extension (shown in phantom) of the leftmost block (144) by means of its slide 146 from a neutral to an extended rightmost position. Note that the rightmost block 128 does, in fact, extend as the leftmost block 126 extends due to the connecting rod 130. This extension of the rightmost block 128 allows a coin to enter into the slot 148 formed between the rightmost 128 and the intermediate block set 140. A coin 150 in this rightmost slot 148 is depicted in FIGS. 12 and 13 (front view). If a coin enters the slot 148 between the intermediate block assembly 140 and rightmost block 128, then upon return of the slide 146 to a neutral position, the coin acts to fill the gap and connect the rightmost block 128 with the intermediate blocks 140. Thus, intermediate assembly 140 travels along with the leftmost block 126 repositioning all three coins 150, 152, 154 shown. Following return of the intermediate assembly 140 to an unextended (leftmost) position, it may again be extended by contact between blocks on the slide and intermediate assembly 126, 156 respectively.

A second type of block structure 158 is depicted in FIGS. 14–16. Unlike the block structure 124 depicted in FIG. 9, this arrangement is structured with separate leftmost and rightmost assemblies 160, 162 so that the extended rightmost assembly 162 (note FIG. 16) always returns to a neutral position in response to the return of the slide-carrying leftmost assembly 160 to a neutral position. The operation of this block arrangement 158 is detailed in FIGS. 15 and 16. Note that the slide-carrying leftmost assembly 160 includes, upon its guiding lug 164, an elongated hook 166 that interengages with a hollow 168 in the adjacent rightmost block assembly 162. If no coin is present between the slide carrying blocks 160 and rightmost assembly 162, this rightmost assembly 162 is incapable of movement from unextended to extended positions (FIG. 15). However, if a coin is placed in the slot 170 between the unextended slide block portion 160 and rightmost block assembly 162, the user may move the rightmost block assembly 162 to the right as the slide 165 is extended. In this extended position, the slide's hook 166 abuts and engages the far leftmost shoulder 172 of the hollow 168 of the rightmost block assembly 162. As such, whether or not a coin is subsequently present in the slot between the slide-carrying block 160 and rightmost block assembly 162, the slide 165 may always withdraw the rightmost block assembly 162 leftward back to an unextended as the slide 165 is moved back to a neutral position. This contrasts directly with the type of block 124 depicted in FIG. 9 wherein in order to subsequently withdraw the intermediate block assembly 140 leftward, a second coin in the rightmost slot 148 is necessary.

A third and more complex variation of the block structure 158 of FIG. 14 is depicted in FIG. 17. This structure 173 utilizes lug mounted hooks 174, 175 and corresponding hollows 176, 177 between blocks similar to those shown in FIG. 9. In addition, the three discrete block assemblies 178, 180, 182 are utilized in this structure. The leftmost block 178 includes a hook 174 positioned in a hollow 174 in the adjacent intermediate block 180 which itself hooks (175) into the hollow 177 in rightmost block 182. Thus, as depicted in FIG. 18, a coin must be disposed in the slot 184 between the leftmost block 178 and intermediate block 180 in order to move the intermediate block assembly 180 from a neutral to a rightward extended position. At any time, owing to the hook 174, the extended intermediate block assembly 180 may be moved back into the neutral position by moving the slide 186 to neutral. Similarly, a coin must be disposed in the slot 188 between the intermediate and rightmost block assemblies 180, 182 in order to move the rightmost block assembly 182 rightwardly. According to this structure, each block is dependent for movement upon the preceding block. Thus, if no coin is present in the leftmost slot 184, neither the intermediate nor rightmost block assemblies 180, 182 will move. Similarly, if a coin is only present in the leftmost slot 184 but not in the adjacent right slot 190, the intermediate block assembly 180 will move but the rightmost block assembly 182 will fail to move. Again, each block may be returned leftwardly to the neutral position once extended owing to the engagement of each hook 174, 175 with the leftmost shoulder of the corresponding hollow 176, 177. Since two separate disconnected extendable block structures are utilized in this structure, each assembly includes its own set of indentations 192 upon its lug 194 and corresponding spring arms in the guide channel (not shown).

An even more complex block structure 200 that may, in fact, prove too challenging for most general usage games is illustrated in FIG. 19. This structure 200 utilizes both the hook 202 and hollow 203 concept of FIG. 14 and connecting rod 204 concept of FIG. 9 in the same structure positioned upon an opposing sides of the lug 205 from each other. Thus, as shown in FIG. 20, moving the slide 206 rightwardly without a coin adjacent to its block 208 fails to move the intermediate block section 210 rightwardly. However, once the intermediate block section 210 is moved rightwardly it may be withdrawn either by means of the hook 202 or, in an alternate position, by means of a rightmost disposed coin 212 in the rightmost slot 214 that is formed by movement of the slide 206 relative to the intermediate block section 210. As such, the pattern of movement for a section having this structure is very complex and depends upon several conditions relating to block and coin positioning.

Figure 23:
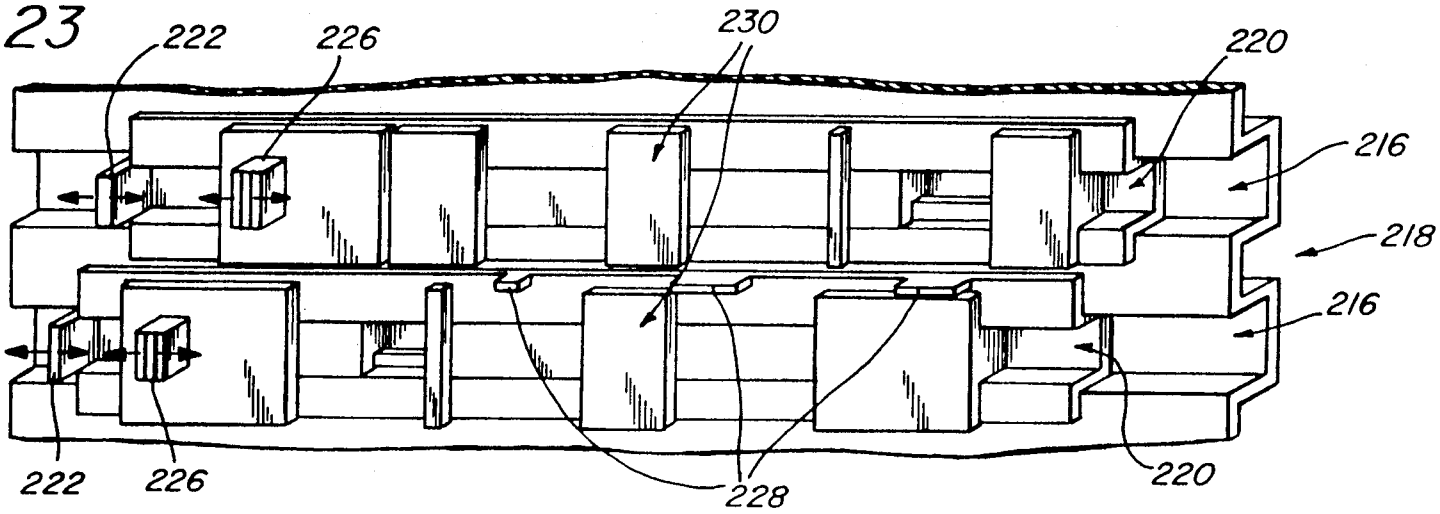
FIG. 23 is a partial perspective front view of an alternative embodiment of the block guiding tray for use with the game of FIG. 1 including a plurality of secondarily moving sections with stops for increasing complexity of vertical motion.

In an alternative embodiment, as depicted in FIG. 23, the block guiding channels 216 of the game case tray 218 may be adapted to guide secondary channels 220 having independent slide controls 222 protruding from the clear panel (not shown) proximate the conventional block slide controls 226. These secondary channels 220 have stops 228 connected to them similar to the fixed stops 68 shown for the game of FIG. 1. By utilizing sliding secondary channels 220, the stops 228 move freely relative to the blocks 230 (whose lugs now ride in the secondary channels 220 in a manner similar to the FIG. 1 embodiment) and the horizontal limits of the blocks are altered, thus, adding a second tier of motion to the game. The rules of the game could be formulated so that each player's moving turn includes a combination of channel stop 228 moves and block 230 moves.

Figure 24:
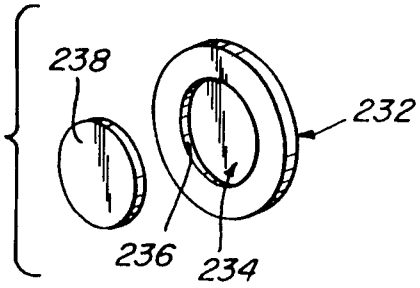
FIG. 24 is a perspective view of a standard size coin adaptor allowing the use of various size coins in the game of FIG. 1.

Finally, while the game according to this invention is adapted to receive a particular size of coin, a special adaptor slug 232 as shown in FIG. 24 may be utilized in order to enable the use of different sized coins while leaving game slot dimensions unchanged. The adaptor slug 232 could be sized according to accept particular international coin sizes or to different denomination U.S. and Canadian coins. A slug 232 according to this invention could be produced by providing a central orifice 234 to a resilient plastic disk sized similarly to a quarter The orifice 234 would include a slightly undersized diameter with slightly dished (concave) inner walls 236 about its circumference. As such, the desired coin 238 could be snap fitted into the plastic disk. The slug mounted coin could then be used as a playing piece allowing standardization of the coin size used with the game while simultaneously enabling the use of different denomination, or foreign denomination, coins. Note, that disks with various predetermined orifice sizes could be employed to allow the assignment of different values to different playing pieces which adds an added level of complexity of the game as players try to retrieve the highest denomination coins.

It should be understood that the preceding is merely a detailed description of the preferred embodiments. It should be apparent to those skilled in the art that various modifications and equivalents may be made without departing from the spirit or scope of the invention. The preceding description is meant to be taken only by way of example, and to describe only the preferred embodiments and not to otherwise limit the scope of the invention.

What is claimed is:

1. A slot game comprising:

an enclosed partially transparent case having, at an upper end thereof, means for inputting coins into one of a plurality of vertical columns and further having means, positioned at a lower end, for retrieving coins from the vertical columns;

a plurality of horizontal rows of blocks and slots sized to receive coins therein oriented relative to the columns disposed from top to bottom, the blocks and slots being movable horizontally to allow movement of coins between columns for passage of coins in the slots from upper to lower rows; and means for individually activating each of the rows of blocks and slots to move them each horizontally.

2. A slot game of claim 1 wherein the blocks of each of the rows are irregularly sized in horizontal width and are irregularly positioned horizontally upon the row relative to the blocks in adjacent rows.

3. A slot game as set forth in claim 2 wherein the means for moving includes disconnect means between blocks of at least one of the rows allowing horizontal movement of predetermined blocks only in response to the positioning of coins within predetermined slots in that row.

4. A slot game as set forth in claim 3 further comprising stops having a predetermined horizontal length positioned between rows preventing the movement of coins between rows predetermined horizontal positions and allowing the movement of coins between rows in other horizontal positions.

5. A slot game as set forth in claim 4 wherein predetermined blocks include a lug connected thereto that rides horizontally within a guide channel formed upon the case without substantial vertical movement.

6. A slot game as set forth in claim 5 wherein the means for activating includes a finger actuated slide projecting from the case along one side thereof.

7. A slot game as set forth in claim 6 wherein each of the rows is adapted to be positioned in one of either an extended and unextended position.

8. A slot game as set forth in claim 7 further comprising means for releasably locking the lugs of each of the rows in at least one of the extended and unextended position.

9. A slot game as set forth in claim 8 wherein the means for releasably locking includes a spring arm within the guiding channel and a corresponding formation engaging the spring arm on the lug.

10. A slot game as set forth in claim 4 wherein the stops are mounted upon a slidable guide enabling horizontal repositioning of the stops relative to the case.

11. A slot game as set forth in claim 3 wherein the disconnect means includes a connecting rod between oppositely disposed blocks in a row and an intermediate set of blocks mounted upon a lug having a channel sized to accept the connecting rod, the opposing blocks movable independently of movement of the intermediate blocks.

12. A slot game as set forth in claim 3 wherein the disconnect means includes a hook in one set of blocks engaging a hollow in the lug of a separate set of blocks, the hook and hollow being configured so that the hook abuts a shoulder of the hollow when the set of blocks carrying the hollow is fully extended so that movement of the set of blocks having the hook to an unextended position moves the set of blocks having the hook back to an unextended position.

13. A slot game as set forth in claim 12 wherein the set of blocks having a hollow also includes, disposed upon an opposite side of the lug, a second hook engaging a second hollow in another set of blocks adjacent thereto.

14. A slot game as set forth in claim 1 wherein the means for retrieving includes an exit slot through which coins pass out of the case.

15. A slot game as set forth in claim 14 wherein the means for retrieving includes handle means for selectively allowing coins in the bottom most row to pass through the exit slot.

16. A slot game as set forth in claim 15 wherein the handle means includes a cylinder having a plurality of throughout notches thereon positioned proximate to each of the columns that selectively cover and open a passage to the exit slot.

17. A slot game as set forth in claim 1 wherein the coins are sized and configured substantially as U.S. quarters.

18. A slot game as set forth in claim 1 wherein the coins include standard sized slugs having an orifice therein for accepting undersized coins.

19. A game in which players move coins vertically from an uppermost to a lowermost position in a maze comprising:

a frame having a transparent front panel;

means for introducing coins into a top portion of the frame;

means for removing coins proximate a bottom portion of the frame;

a plurality of horizontally disposed rows of block and vertical slot means disposed between the top portion and the bottom portion of the frame, the block and slot means having blocks that prevent the impingement of coins between the frame and transparent panel and slots that allow the impingement of coins between the frame and transparent panel; and means for horizontally reorienting predetermined of the blocks and slots of each row individually so that coins positioned in upper slots may pass into adjacent lower slots.

20. A game as set forth in claim 17 wherein the means for horizontally reorienting includes disconnect means that allows movements of predetermined blocks and slots in a predetermined row only if a coin is positioned in at least one predetermined slot in the row.

21. A slot game as set forth in claim 20 wherein the disconnect means includes a connecting rod between oppositely disposed blocks in a row and an intermediate set of blocks mounted upon a lug having a channel sized to accept the connecting rod, the opposing blocks movable independently of movement of the intermediate blocks.

22. A slot game as set forth in claim 20 wherein the disconnect means includes a hook in one set of blocks engaging a hollow in the lug of a separate set of blocks, the hook and hollow being configured so that the hook abuts a shoulder of the hollow when the set of blocks carrying the hollow is fully extended so that movement of the set of blocks having the hook to an unextended position move the set of blocks having the hook back to an unextended position.

23. A slot game as set forth in claim 22 wherein the set of blocks having a hollow also includes, disposed upon an opposite side of the lug, a second hook engaging a second hollow in another set of blocks adjacent thereto.

24. A game as set forth in claim 17 further comprising means for limiting horizontal movement of each of the blocks and slots of each row.

25. A game as set forth in claim 24 wherein the means for horizontally limiting includes secondary slide means for horizontally repositioning end limits of predetermined rows.

26. A game as set forth in claim 25 wherein the secondary slide means includes stops having predetermined horizontal length for preventing movement of coins between rows at predetermined horizontal positions.

27. A game in which one or more players move objects in a generally vertical path from an uppermost position to a lowermost position at least partially by gravity, said game comprising, a housing having means for receiving at least one object thereinto, a plurality of blocks for interrupting vertical transition of an object, said plurality of blocks being arranged with at least one block in each of a plurality of horizontally disposed rows, each said row having means including a block defining a slot for permitting passage of an object, and means associated with each of the rows for actuating the row block to move it horizontally to facilitate vertical object movement.

* * * * *